US010121340B2

(12) United States Patent
Yang

(10) Patent No.: US 10,121,340 B2
(45) Date of Patent: Nov. 6, 2018

(54) EAS DEVICE WITH CONDUCTIVE SEALING TAPE

(71) Applicant: Xiao Hui Yang, Saratoga, CA (US)

(72) Inventor: Xiao Hui Yang, Saratoga, CA (US)

( * ) Notice: Subject to any disclaimer, the term of this patent is extended or adjusted under 35 U.S.C. 154(b) by 0 days.

(21) Appl. No.: 15/461,747

(22) Filed: Mar. 17, 2017

(65) Prior Publication Data

US 2017/0270758 A1 Sep. 21, 2017

Related U.S. Application Data

(60) Provisional application No. 62/309,461, filed on Mar. 17, 2016.

(51) Int. Cl.
*G08B 13/14* (2006.01)
*G08B 13/24* (2006.01)

(52) U.S. Cl.
CPC ..... *G08B 13/2434* (2013.01)

(58) Field of Classification Search
CPC ..... G08B 13/2434
USPC ..... 340/572.8
See application file for complete search history.

(56) References Cited

U.S. PATENT DOCUMENTS 7,671,741 B2 3/2010 Lax et al.
7,961,100 B2 6/2011 Wyatt, Jr. et al.
8,274,391 B2 9/2012 Yang
8,284,062 B2 10/2012 Wyatt, Jr. et al.
8,305,219 B2 11/2012 Yang
8,334,776 B2 12/2012 Yang
8,368,542 B2 2/2013 Yang
8,368,543 B2 2/2013 Yang
8,373,564 B2 2/2013 Wyatt, Jr. et al.
8,373,565 B2 2/2013 Yang
8,514,078 B2 8/2013 Lax et al.
2011/0115632 A1* 5/2011 Yang ..... G08B 13/1463 340/572.8
2014/0077953 A1 3/2014 Yang
2014/0253290 A1 9/2014 Yang
2015/0302711 A1 10/2015 Yang

* cited by examiner

*Primary Examiner* — Tanmay Shah
(74) *Attorney, Agent, or Firm* — Brian W. Foxworthy; Robert R. Waters; Waters Law Group, PLLC

(57) ABSTRACT

An electronic article surveillance apparatus for monitoring boxes, crates, and other items having lids is comprised of a base, an electronics housing, and a sealing tape for sealing the lid. The sealing tape is fixed to the base. Adhesive on the base and sealing tape allow them to be fixed to a box. The sealing tape is placed over the edge of the lid. The sealing tape has a conductive loop within it and the ends of the conductive loop terminate on the base. The electronics housing mounts to the base and contacts on the electronics housing contact the ends of the loop to complete a circuit. The electronics within the housing monitor the integrity of the sealing tape. If the sealing tape is torn, the electronics interpret that as an attempt to open the box and remove its contents. The electronics then generate an alarm.

20 Claims, 7 Drawing Sheets

EAS DEVICE WITH CONDUCTIVE SEALING TAPE

CROSS REFERENCE TO RELATED APPLICATIONS

This application is a utility application which claims priority to U.S. Provisional Application 62/309,461, filed on Mar. 17, 2016. The entire disclosures contained in U.S. Provisional Application 62/309,461 including the attachments thereto, are incorporated herein by reference.

FIELD OF INVENTION

The present application is generally related to an electronic article surveillance (EAS) device. More specifically, the present application relates to an EAS device that uses ribbon or tape having a conductive loop to seal cartons, boxes, etc.

BACKGROUND OF THE INVENTION

Theft in retail establishments is a consistent problem. There are numerous systems for preventing theft. In general, the systems consist of setting up an electronic article surveillance (EAS) monitoring system of antennas, computers, etc. for an area that is to be controlled. Electronic article surveillance (EAS) devices are attached to objects that are desired to be protected. In their simplest embodiments, the EAS devices comprise passive EAS elements that are capable of generating response signals when exposed to interrogation fields.

The interrogation fields are frequently established at exits. The interrogation fields are generated intermittently. When a passive EAS element is in an active interrogation field, the interrogation field generates energy in the passive elements. When the interrogation field turns off, this energy dissipates and generates a signal. The EAS system monitors for signals while the EAS interrogation field is off If a signal is detected by the EAS system, the EAS system evaluates that signal as indicating that an EAS device, and the item to which it is attached, is in the field zone. The EAS system may then generate an alarm. Through convention and regulation, EAS systems operate at discrete common frequencies.

More sophisticated EAS devices may have elements of memory and logic. These more sophisticated devices can store information, communicate information with the EAS system, be reprogrammed, monitor the integrity of the EAS device, etc. There are a wide variety of methods of attaching EAS devices to a product that is desired to be protected from theft. Both the attaching method and the communication system of an EAS device may be attacked to effect the theft of an item.

Some EAS devices are attached, or glued, to a box or carton containing a product with an adhesive element that keeps the EAS device on the box. In some embodiments, the adhesive element is on a less expensive base that is considered disposable. The more expensive portion of the EAS device containing the electronics can be removed from the base and reused. One technique for defeating EAS devices glued to a box is to open the lid of the box and remove the product from the box. The EAS device remains with the box and the automatic EAS system is defeated. A thief then only needs to be able to conceal the product as they exit the controlled area. Embodiments of the EAS device of the present application are an effective counter measure to removing the product from the box.

RELEVANT ART

U.S. Pat. No. 8,274,391 by Yang is for an "EAS tag using tape with conductive element". An electronic article surveillance apparatus for monitoring large objects is comprised of a base, at least one segment of tape, and an electronics housing. The segment of tape has at least one electrically conductive element running the length of the tape. The base rests on an object to be monitored, and the housing releasably latches onto the base, while each tape segment wraps around the object with each end of tape segment being fixed between the base and housing. Electronics within the housing complete a circuit through each tape segment and monitor the tape segments for electrical continuity. If electrical continuity is lost, either by cutting a tape segment, or unauthorized unlatching of the housing, an alarm can be sounded by the electronics within the housing. The electronic housing may be disarmed by a remote device and unlatched from the base. Both base and tape segments may have adhesive elements.

U.S. Pat. No. 8,305,219 by Yang is for "EAS tag using tape with conductive element". An electronic article surveillance apparatus for monitoring large objects is comprised of a base, at least one segment of tape, and an electronics housing. The segment of tape has at least one electrically conductive element running the length of the tape. The base rests on an object to be monitored, and the housing releasably latches onto the base, while each tape segment wraps around the object with each end of tape segment being fixed between the base and housing. Electronics within the housing complete a circuit through each tape segment and monitor the tape segments for electrical continuity. If electrical continuity is lost, either by cutting a tape segment, or unauthorized unlatching of the housing, an alarm can be sounded by the electronics within the housing. The electronic housing may be disarmed by a remote device and unlatched from the base. Both base and tape segments may have adhesive elements.

U.S. Pat. No. 8,368,542 by Yang is for "EAS tag using tape with conductive element". An electronic article surveillance apparatus for monitoring large objects is comprised of a base, at least one segment of tape, and an electronics housing. The segment of tape has at least one electrically conductive element running the length of the tape. The base rests on an object to be monitored, and the housing releasably latches onto the base, while each tape segment wraps around the object with each end of tape segment being fixed between the base and housing. Electronics within the housing complete a circuit through each tape segment and monitor the tape segments for electrical continuity. If electrical continuity is lost, either by cutting a tape segment, or unauthorized unlatching of the housing, an alarm can be sounded by the electronics within the housing. The electronic housing may be disarmed by a remote device and unlatched from the base. Both base and tape segments may have adhesive elements.

U.S. Pat. No. 8,373,565 by Yang is for "Security apparatus with conductive ribbons". An electronic article surveillance (EAS) security apparatus is comprised of a housing, base plate, ribbon pad, and electrically conductive ribbons. In one embodiment, the ribbons are pre-attached to the ribbon pad and extend from the ribbon pad. The ribbon pad and base plate are installed on opposite sides of an object to be protected. The ribbons are extended around the object and their extended ends attached to the base plate. The housing has electrical contacts and encloses electronics and is attached to the base plate so that the electrical contacts complete circuits through the ribbons. The electronics in the housing monitor the ribbons to detect unauthorized removal of the apparatus. A switch on the bottom of the housing detects that the housing is attached to a plate and object. The apparatus has a locking mechanism to maintain the housing and plate together, which can be released by application of a magnet.

SUMMARY OF EMBODIMENTS OF THE INVENTION

Embodiments of the present electronic article surveillance (EAS) device have an electronics housing portion, a base portion, and a sealing tape to seal boxes, cartons, and similar containers. The sealing tape is fixed to the base portion and has an open conductive loop on a substrate. Both ends of the open conductive loop are located on the base portion, and the open conductive loop extends out the length of the substrate of the sealing tape. Adhesive on the base and sealing tape allow them to be attached to a box, carton, etc. The sealing tape is run over the edge of a lid. Complimentary attaching elements on the base and housing allow the housing to be mounted to the base. A switch on the housing detects when the EAS device is attached to an object. Contacts on the bottom of the housing contact the ends of the conductive loop to complete a circuit between the conductive loop and the electronics within the housing. Once the EAS device is attached to an object, the electronics within the housing monitor the switch to detect forced removal of the device and monitor the integrity of the sealing tape. If the tape is torn and the electronics have not been disarmed, it indicates that an attempt is being made to remove contents of the box without authority.

The electronic housing portion of the EAS device may have several components within it, including: a microprocessor, a circuit board, a battery, an EAS core and coil element, the switch referenced above, an audible alarm producing device, an infrared communication port or other communication elements, and a light emitting diode. The microprocessor or circuit board can detect when the switch is depressed and when circuits are created on its electrical contacts to determine that the electrical housing portion of the EAS device has been joined with a base portion and the conductive sealing tape on an object. In that condition, the EAS device may be armed with an arming device that communicates with the device via the infrared communication port, radio frequency communications, or other communication elements, or the electronics may arm based on the state of the switch and the completion of the circuit through the sealing tape.

Once an EAS device is assembled and armed, unauthorized removal of the device is detected by the onboard electronics which sense an alarm condition via changes in state of any conditions required to arm the EAS device, such as changes to the switch or tearing the sealing tape. In response to a detected alarm condition, the electronics can generate an alarm, including onboard audible alarms, or alarms communicated to the EAS system via infra red signals, radio frequency signals, or other communication methods.

Disarming of the EAS device may be accomplished by authorized personnel. An authorized person having access to other elements of the EAS system such as a hand held communication device or a base station having communication capabilities may disarm the device. Some embodiments will add another element of security with passcode capabilities in the respective electronics. The EAS device electronics of these embodiments are capable of storing a passcode which is known to the communication elements of the EAS system and which can be used to confirm to the EAS device that the disarming signal is authorized. If an EAS device is detached without being disarmed with the appropriate passcode, the EAS device will detect an alarm condition and generate an alarm.

To physically prevent the release of the latch and the detaching of the housing portion from the base portion, a blocking component or mechanism may be employed. In one embodiment, a biased blocking member moves into a blocking position when the latch engages between the housing portion and the base portion. The biased blocking member has a magnetically attractable element associated with it, and when a magnet is applied to the EAS device, the biased blocking member moves to a position where it no longer blocks the release of the latch. If a magnet is used to detach an EAS device without authorization and the EAS device is still armed, the electronics detect an alarm condition and generate an alarm. In some embodiments, a magnet may be built into a communication device so that the EAS device may be disarmed and its latch released for detachment using the same device.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Figure 2:
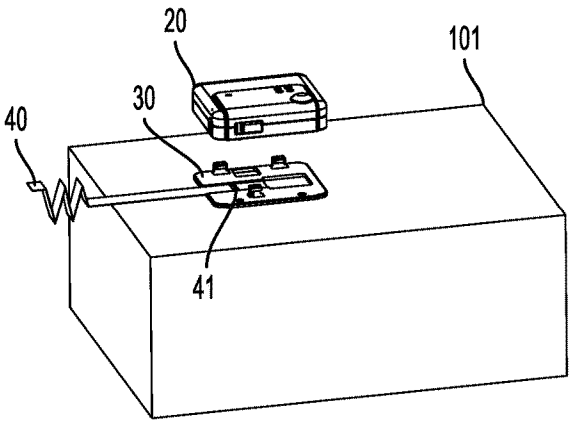
FIG. 2 shows an embodiment of an EAS device with conductive sealing tape with the base attached to a box.
Figure 1:
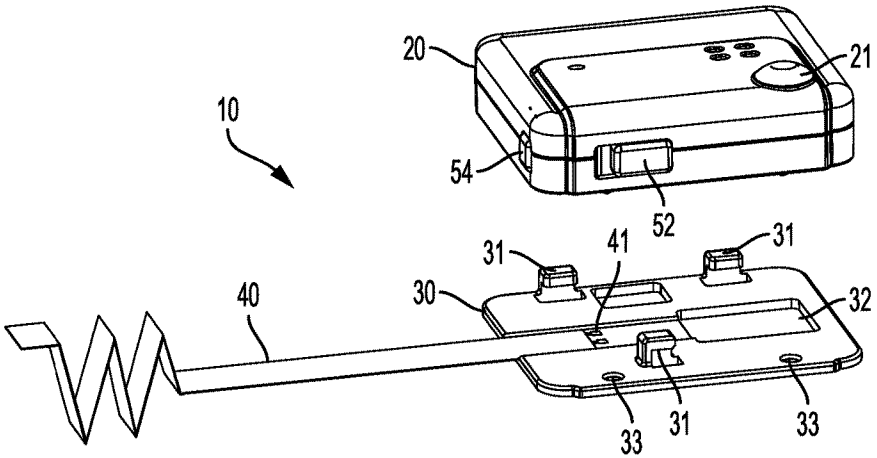
FIG. 1 shows an embodiment of an EAS device with conductive sealing tape.

FIG. 1 shows an embodiment of EAS device 10 with conductive sealing tape 40, a housing portion 20 and a base portion 30. Conductive sealing tape 40 is fixed to base 30 and both conductive sealing tape 40 and base portion 30 have adhesive on their underside. The adhesive is covered with peelable covers until EAS device 10 is attached to a box, carton, etc. Base 30 has mounting hooks 31, switch aperture 32, and alignment apertures 33 which will be discussed below. Housing portion 20 has engagement slide 52, release button 54, and dome 21, which will be discussed further below. FIG. 2 shows an embodiment of EAS device 10 with conductive sealing tape 40 with base portion 30 attached to box 101 and housing portion 20 about to be connected to base portion 30.

Figure 3:
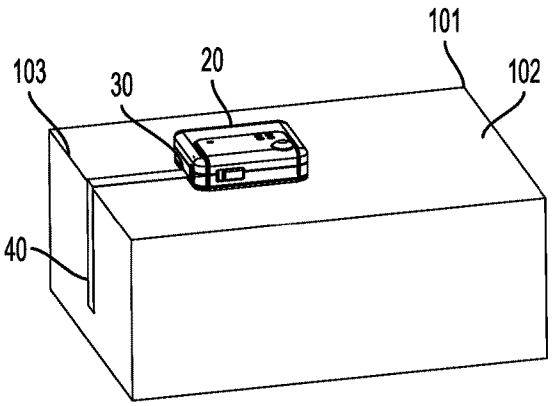
FIG. 3 shows an embodiment of an EAS device with conductive sealing tape with the base and housing attached to a box and the sealing tape applied over the edge of the lid.

FIG. 3 shows an embodiment of EAS device 10 with conductive sealing tape 40 with base 30 and housing 20 attached to box 101 and sealing tape 40 applied over the edge 103 of the lid 102 of box 101. Once installed, EAS device 10 may be armed. Arming of EAS device 10 may occur inherently with the installation of housing portion 20 on base 30 or the installation of housing portion 20 on base 30 may be a prerequisite for arming which may be finalized by communication from an external device.

Sealing tape 40 has a conductive loop 42 within it. The loop 42 has two ends which terminate between housing portion 20 and base portion 30. Conductive loop 42 extends out to the end of sealing tape 40. Each end of the loop 42 has an exposed loop contact 41. (See FIG. 5) Housing portion 20 has contact prongs 151 on its bottom that are positioned to contact the loop contacts 41 and complete a circuit between electronics in housing 20 and the conductive loop 42. Sealing tape 40 and its conductive loop 42 are constructed to be easily torn. When EAS device 10 is installed and armed, electronics within housing portion 20 monitor the conductive loop. If the circuit including conductive loop 42 is interrupted, EAS device 10 determines an alarm condition and generates an alarm.

Figure 4:
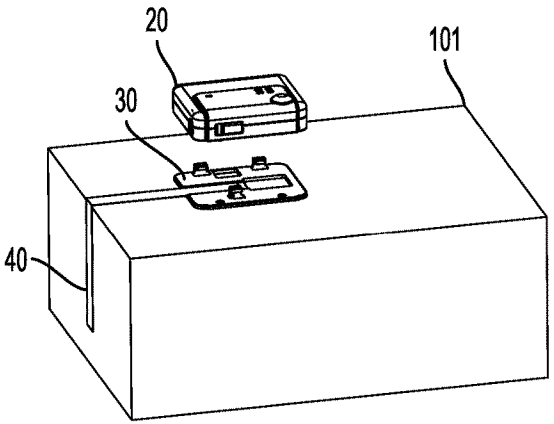
FIG. 4 shows an embodiment of an EAS device with conductive sealing tape with the housing removed from base and the base and tape left as disposable.

FIG. 4 shows an embodiment of an EAS device 10 with conductive sealing tape 40 with housing 20 removed from base 30. Base 30 and sealing tape 40 are left as disposable. When the goods within box 101 are purchased, an authorized store personnel can detached housing portion 20 from base 30 and leave base 30 and sealing tape 40 in location on box 101. Base portion 30 and sealing tape 40 are relatively without value and essentially disposable as compared to housing portion 20.

Figure 5:
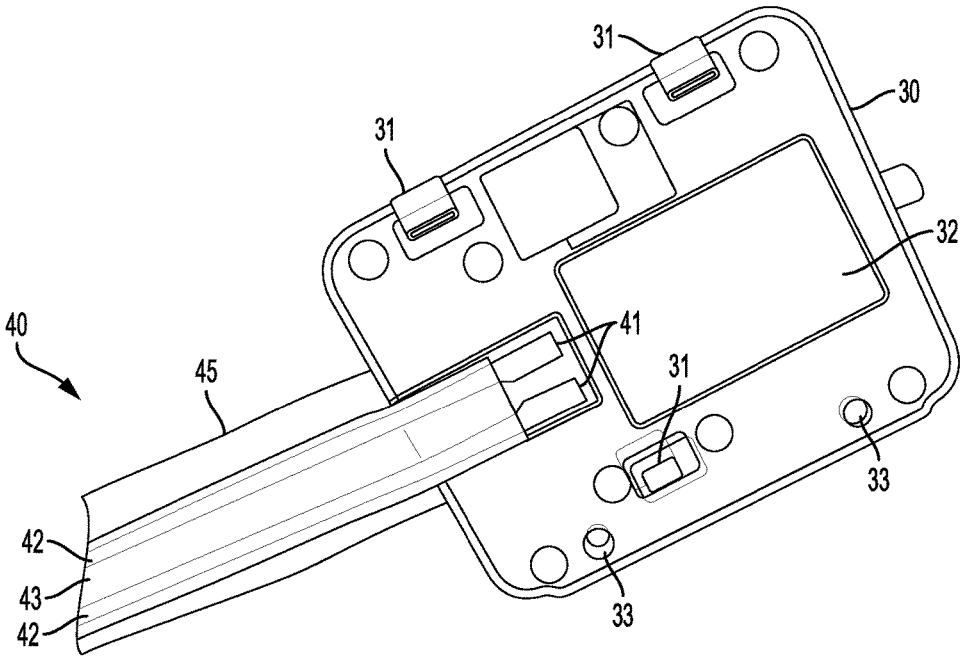
FIG. 5 is a plan view of an embodiment of the base and conductive sealing tape of the EAS device preassembled showing the exposed contacts of the conductive sealing tape.

FIG. 5 is a plan view of an embodiment of base 30 and conductive sealing tape 40 of EAS device 10 preassembled showing exposed contacts 41 of conductive sealing tape 40. Peelable strip 45 is on the underside of conductive sealing tape 40 and covers adhesive on the underside of conductive sealing tape 40 until EAS device 10 is attached to a box, carton, etc. The embodiment of base portion 30 of FIG. 5 also has mounting hooks 31, switch aperture 32, and alignment apertures 33.

Figure 6:
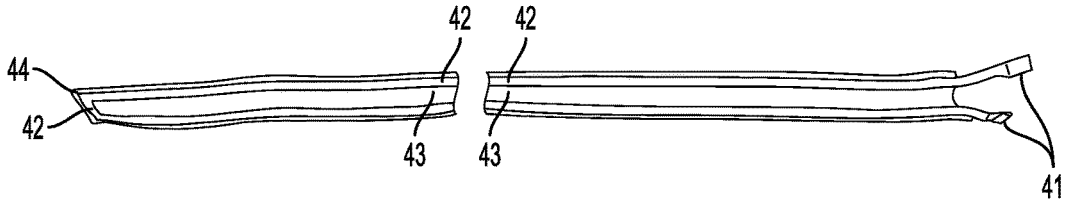
FIG. 6 shows the underside of a conductive sealing tape showing both ends of the substrate and the conductive loop on it.

FIG. 6 shows the underside of a conductive sealing tape 40 showing both ends of the conductive sealing tape 40 with conductive loop 42 on substrate 43. Conductive loop 42 may be in or on substrate 43 of conductive sealing tape 40, i.e. conductive loop 42 may be embedded within substrate 43 of conductive sealing tape 40 or it may be on the surface of a substrate 43, such as indicated in FIG. 6. Conductive loop 42 runs from one exposed contact 41, out to end 44 of conductive sealing tape 40, across end 44 of conductive sealing tape 40, then back to the other exposed contact 41. Conductive sealing tape 40 may be made to different lengths. For example, the EAS device 10 being fixed to the top of a box 101, shorter lengths of conductive sealing tape 40 could pass over the edge of the lid at the top of a box 101, while longer lengths of conductive sealing tape 40 could pass over the edge of lids at the top and bottom of box 101.

Figure 7:
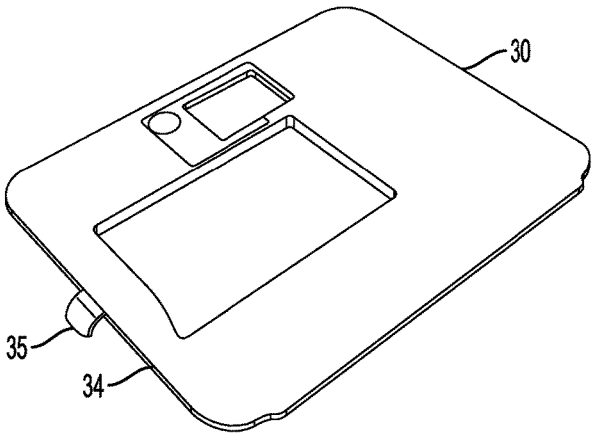
FIG. 7 is a perspective view of the bottom of the base of the EAS device with conductive sealing tape.

FIG. 7 is a photo of the bottom of base portion 30 of EAS device 10 with conductive sealing tape 40. Peelable cover 34 on the bottom of base portion 30 covers adhesive on the bottom of base portion 30 until EAS device 10 with adhesive sealing tape 40 is mounted to a box 101. Tab 35 on peelable cover 34 facilitates the removal of peelable cover 34.

Figure 8:
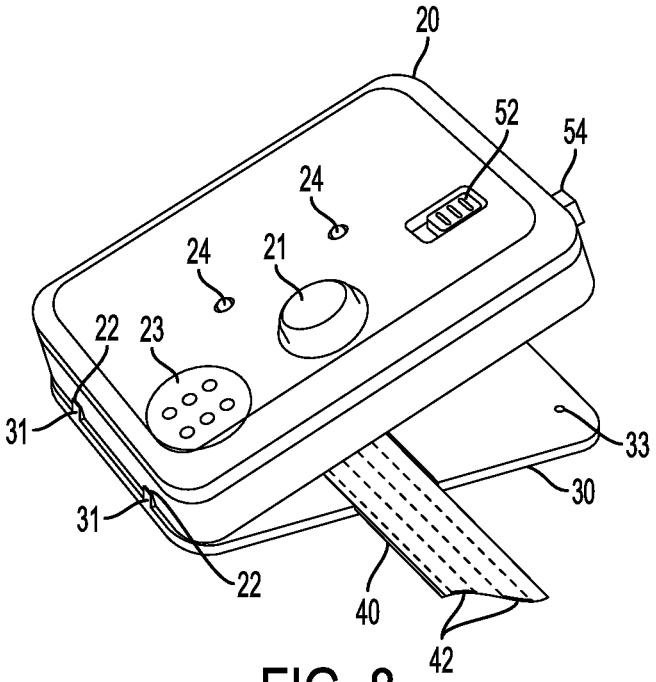
FIG. 8 shows an embodiment of a housing of an EAS device with conductive sealing tape being attached to the base or being detached from the base.

FIG. 8 shows an embodiment of housing portion 20 of EAS device 10 with conductive sealing tape 40 being attached to base portion 30 or being detached from the base portion 30. Mounting hooks 31 of base portion 30 fit into hook receptacles 22 at the edge of the bottom of housing portion 20. Housing portion 20 may be placed down on base portion 30. Then engagement slide 52 can be moved to engage the third mounting hook 31 on base 30 (See FIGS. 1 and 9). Note that engagement slide 52 is located on the top of the embodiment of housing portion 20 in FIG. 8 rather than the side as in FIG. 1. The top of housing portion 20 also has sound apertures 23 and optical apertures 24.

Figure 9:
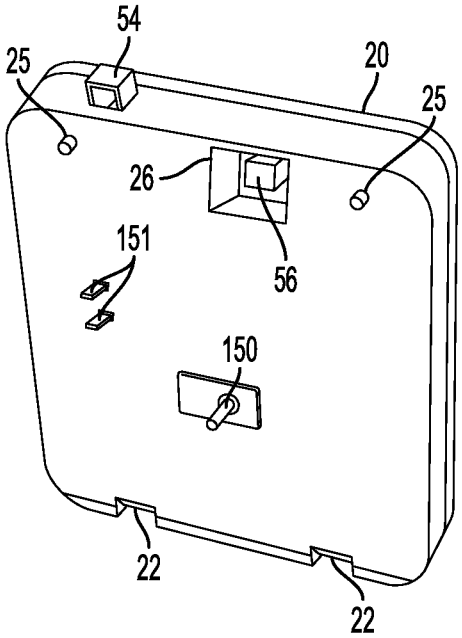
FIG. 9 shows the bottom of an embodiment of a housing for an EAS device with conductive sealing tape.

FIG. 9 shows the bottom of an embodiment of a housing portion 20 for EAS device 10 with conductive sealing tape 40. As previously discussed with respect to FIG. 8, hook receptacles 22 are aligned with mounting hooks 31 of base portion 30. Alignment pins 25 on the bottom of housing portion 20 are positioned to insert in to alignment apertures 33 in base portion 30 (see FIGS. 1 and 8). This facilitates the correct positioning of housing portion 20 and base portion 30 and reinforces and stabilizes their connection.

Latch pocket 26 in the bottom of housing portion 20 houses latch hook 56. Latch hook 56 is a part of latch 50. When housing portion 20 is in position on base portion 30 and latch 50 is manually shifted, latch hook 56 engages the third mounting hook 31 of base portion 30 to latch housing portion 20 and base portion 30 together. Latch 50 is automatically blocked into the latched position and must be manually released to allow housing portion 20 to be removed from base portion 30.

Referring still to FIG. 9, arming switch 150 and contact prongs 151 are part of the electronics package of EAS device 10. Arming switch 150 is positioned to align with a switch aperture 32 in base portion 30. The alignment of arming switch 150 with switch aperture 32 results in arming switch 150 not being affected by the assembly of housing portion 20 to base portion 30 unless the bottom of base portion 30 is contacting an object. When base portion 30 is placed on an object and housing portion 20 is attached to base portion 30, arming switch 150 will be brought into contact with the object and have its state changed; either from open to closed or from closed to open. This is one of the conditions for arming EAS device 10. Contact prongs 151 are positioned to align with contacts 41 on conductive sealing tape 40 (see FIGS. 1 and 5). When housing portion 20 is attached to base portion 30, contact prongs 151 will be brought into contact with contacts 41 on conductive sealing tape 40. This completes a circuit with loop 42 of conductive sealing tape 40 and the electronics within housing portion 20. This is one of the conditions for arming EAS device 10.

Figure 10:
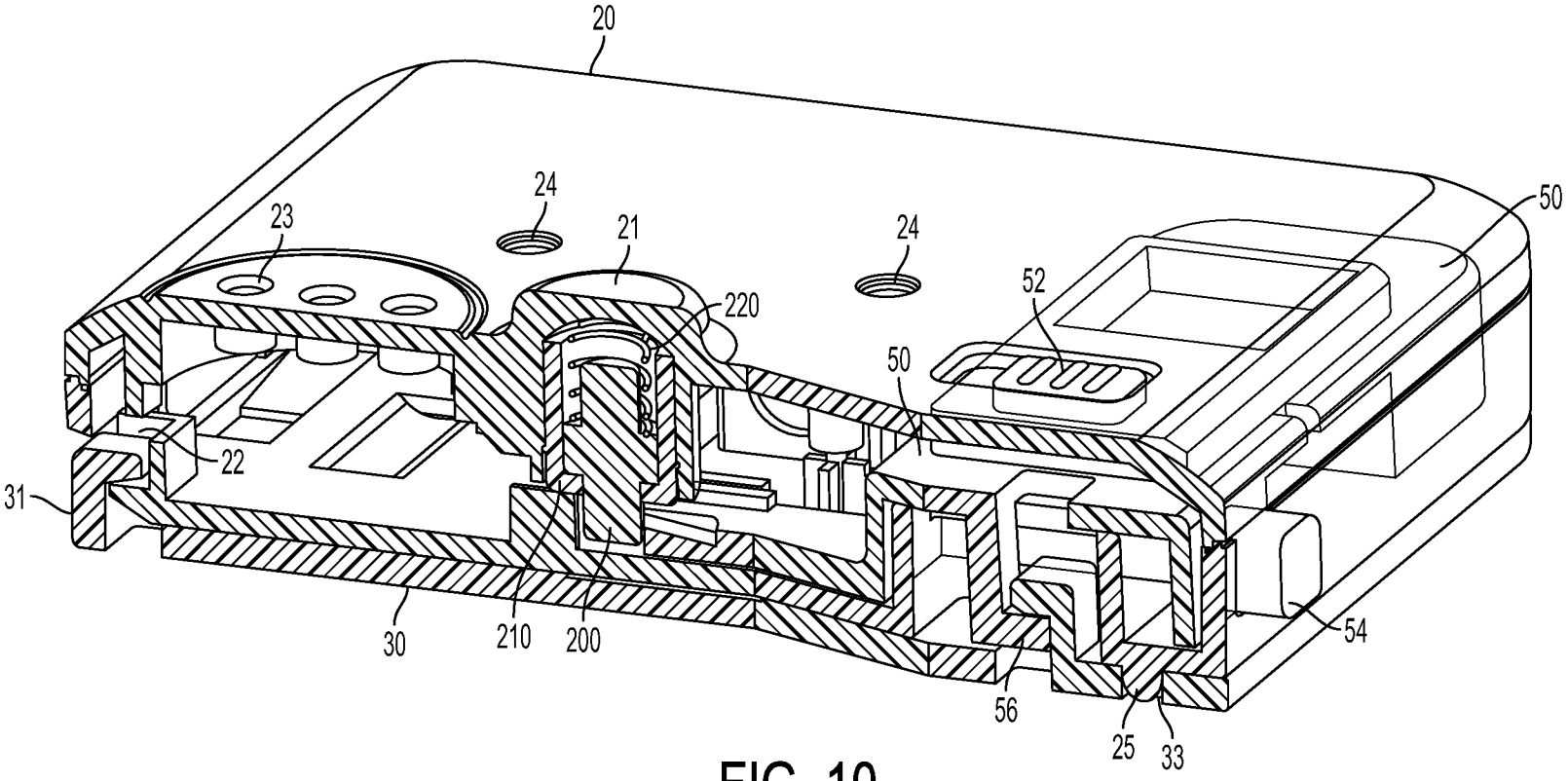
FIG. 10 is a cross sectional view of the housing and base of an embodiment of an EAS device with conductive sealing tape.
Figure 11:
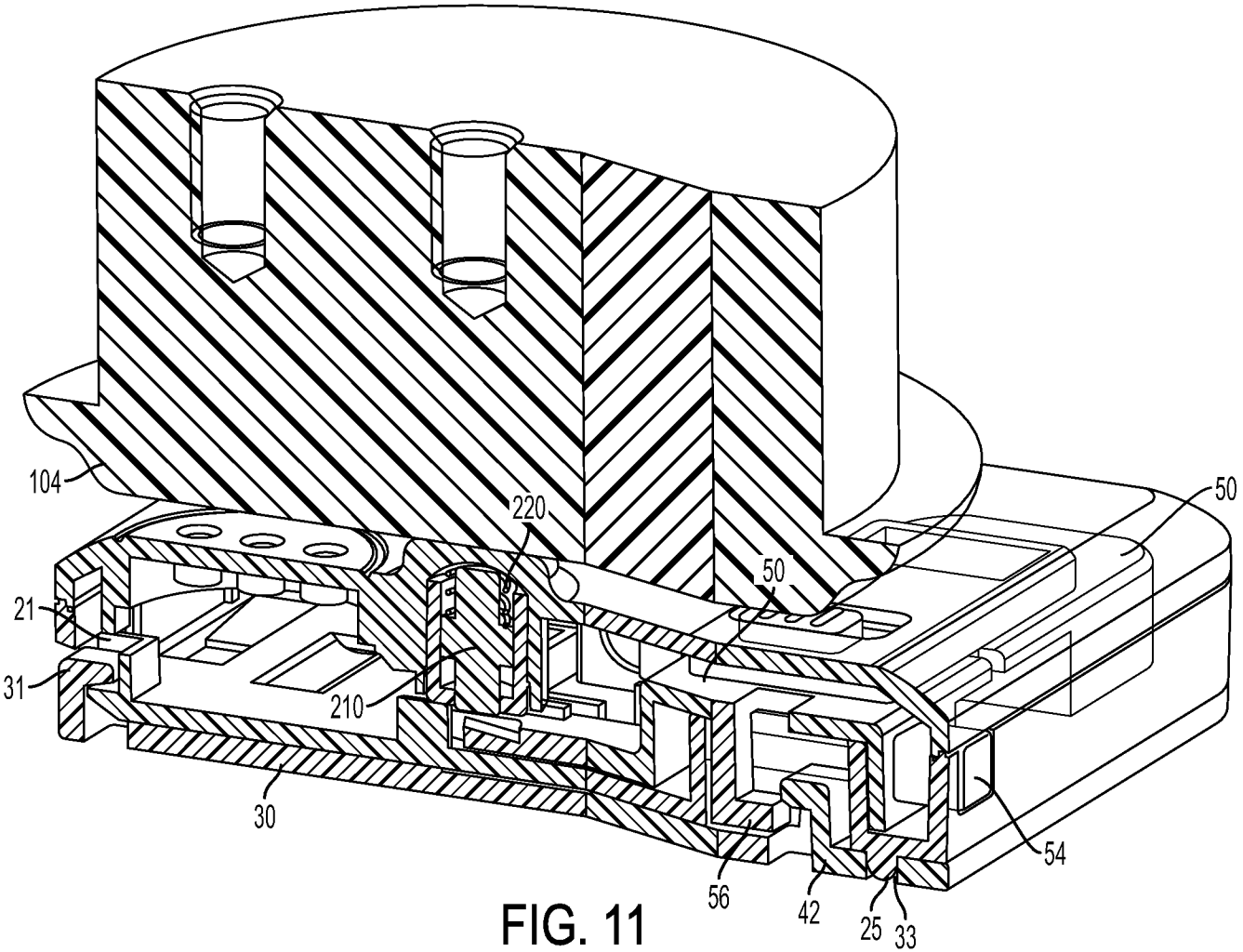
FIG. 11 is a cross sectional view of the housing and base of an embodiment of an EAS device with conductive sealing tape.

FIGS. 10 and 11 are cross sectional views of housing portion 20 and base portion 30 of an embodiment of EAS device 10 with conductive sealing tape 40. FIGS. 10 and 11 show the operation of latch 50 and the mechanism that blocks it into the latched position. Beneath dome 21, blocking pin 200 is contained within cup 210 and spring 220 biases blocking pin 200 toward a blocking position. In FIG. 10, latch 50 is moved to the latched position. This allows spring 220 to move blocking pin 200 to a blocking position. Blocking pin 200 is made at least partially from magnetically attractable material. In FIG. 11, a magnet 104 is applied to dome 21 which pulls blocking pin 200 up out of the blocking position. Latch 50 can then be moved to the unlatched position by pressing release button 56.

Figure 12:
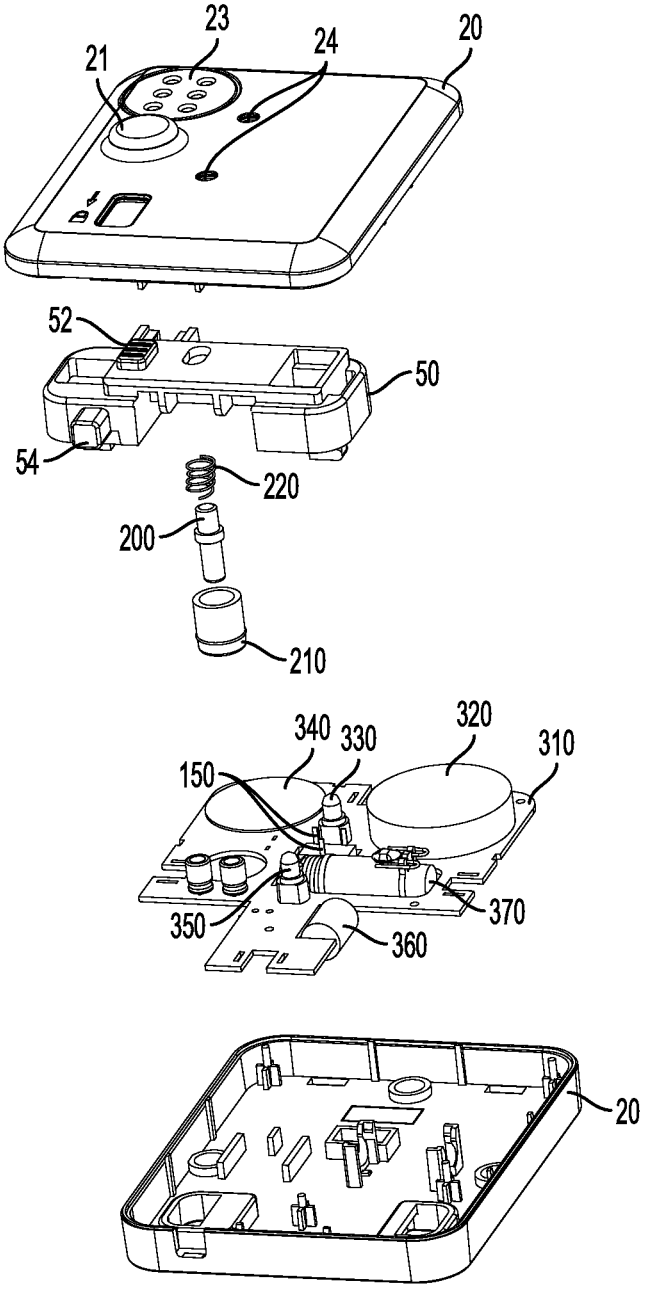
FIG. 12 is an exploded view of an embodiment of a housing for an EAS device with conductive sealing tape showing the electronics within the housing.

FIG. 12 is an exploded view of an embodiment of a housing portion 20 for an EAS device with conductive sealing tape 40 showing the electronics within housing portion 20. Circuit board 310 provides a mount for several of the electronic components. In the embodiment shown in FIG. 12, switch 150, previously described with respect to FIG. 9, is mounted to circuit board 310. Other elements that may be housed within EAS device 10 include microprocessor 320, infrared communication port 330, audible alarm generator 340, light emitting diode 350, and battery 360, many of which may mount directly to circuit board 310. Additionally, housing 10 may also carry a core and coil electronic article surveillance element 370. Contact prongs 151, shown in FIG. 9, are not visible in FIG. 12, but the backside of the location where they join circuit board 310 may be seen near switch 150.

Figure 13:
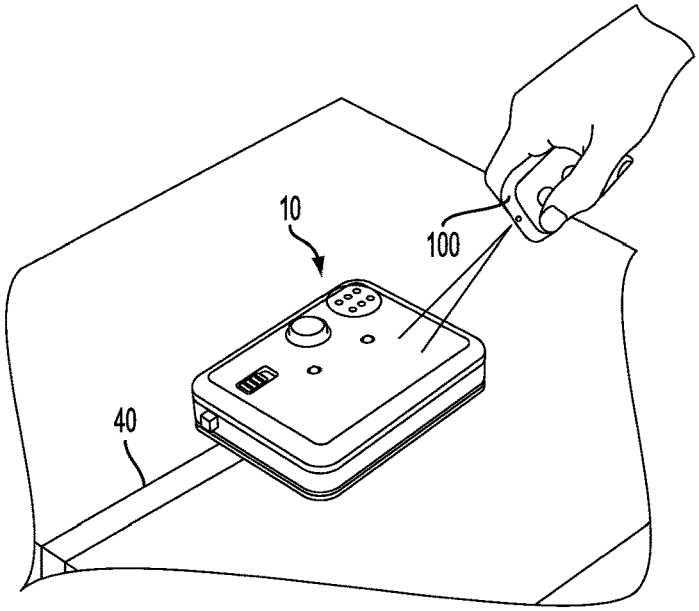
FIG. 13 shows an embodiment of an EAS device with conductive sealing tape being communicated with by an external device.

Circuit board 310 and microprocessor 320 are capable of storing machine readable instructions and are programmable to monitor the status of EAS device 10 and to communicate with remote programs and other elements of an EAS system. Circuit board 310 and microprocessor 320 may be reprogrammed via communication with hand held remotes, such as handheld remote 100 in FIG. 13, or other elements of an EAS system when communicating with these devices. In the embodiment shown in FIG. 12, circuit board 310 and microprocessor 320 can communicate via infrared communication port 330 and also receive programming instructions. Audible alarm generator 340 is capable of generating an audible alarm when EAS device 10 is tampered with, for example, in an attempted forced separation of housing 20 and base 30 or by the tearing or cutting of a sealing tape 40. Audible alarm generator 340 may also be used to indicate the status of EAS device 10 as it is assembled, for example, when the circuit is completed between contact prongs 151 and sealing tape 40, or when switch 150 has been actuated through assembly of housing portion 20 and base portion 30 onto an object. Similarly, LED 350 can be used to provide visual cues for the status of EAS device 10. Battery 360 generally provides power for the electronic components of EAS device 10.

EAS element 370 is a passive element compatible with prior art EAS systems. These EAS systems generate what is called an interrogation field at a given frequency. These interrogation fields will build up a small amount of stored energy on passive EAS elements brought into the zone. When the interrogation field is turned off and the EAS system listens for a response, the passive EAS elements dissipate their energy and generate a signal at a designed frequency. The EAS system is capable of detecting the signal as an indication of the unauthorized presence of the passive elements and can generate an alarm based on the signal. The EAS elements 370 contained within the embodiment of EAS device 10 in FIG. 12 is compatible with prior art and legacy systems providing an addition security mechanism. In addition to the prior art system detection of the passive EAS element 370, in some embodiments circuit board 310 and microprocessor 320 can monitor the status of passive element 370 and issue an alarm as well. If microprocessor 320 or circuit board 310 detects energy storage and dissipation activity in the coil, then audible alarm generator 340 may be instructed to generate an alarm or the communication capabilities of the electronics may be employed to broadcast a signal to respective receivers in the broader EAS system to generate an alarm.

The top of housing portion 20 provides the necessary apertures for the electronic components of EAS device 10 to communicate with its environment. Sound apertures 23 allow audible alarms generated by audible alarm generator 340 easier escape to the surroundings, while optical apertures 24 are generally aligned with infra red communication port 330 and LED 350 to allow direct line of sight communication via those elements. Optical apertures 24 may or may not have some type of translucent covering. Additionally, the top of housing portion 20 has dome 21 where blocking pin 200 is housed which provides a visual cue where to apply magnet 280 to allow disengagement of latch 50.

Hand held device 100 can communicate with EAS device 10 to disarm it. Once it is disarmed, a magnet can be applied to dome 21 to move blocking pin 200 and allow the movement of latch 50. Hand held device 100 and EAS device 10 may communication with infrared communication or radio frequency communication. With the electronics of housing 20 disarmed, housing portion 20 may be lifted from base portion 30 without the electronics in housing portion 20 generating an alarm. Some embodiments of detacher external device 100 and EAS device 10 will exchange an encrypted passcode to offer a further level of security.

Figure 14:
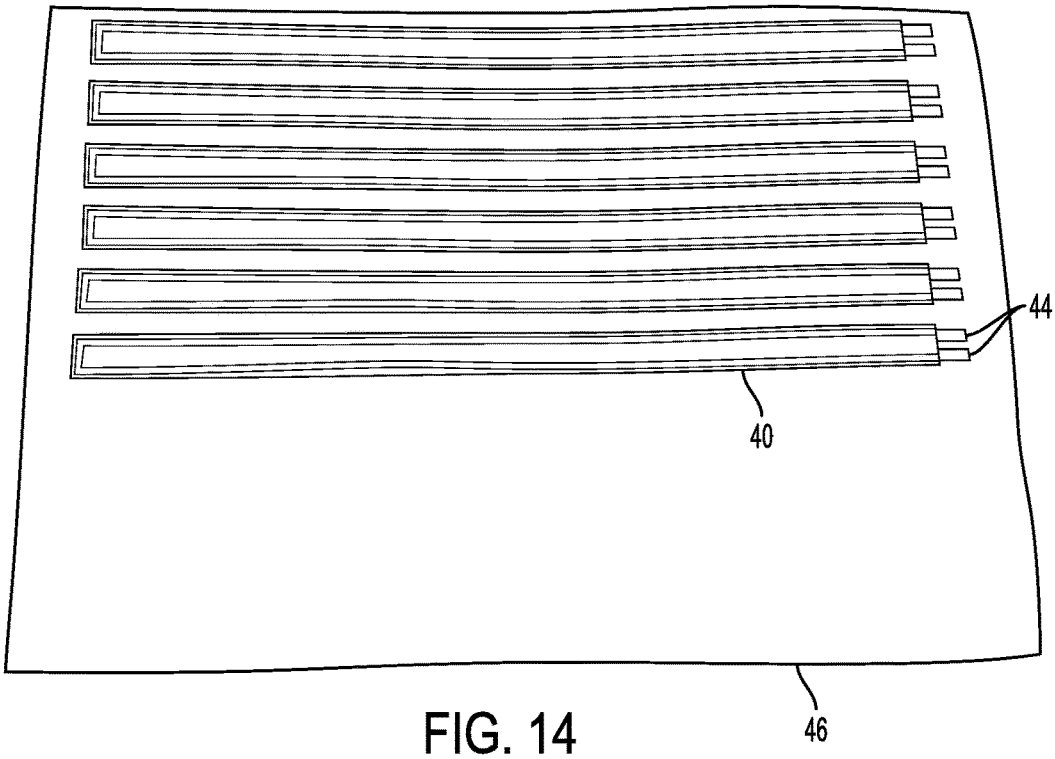
FIG. 14 shows multiple conductive sealing tapes held on a common sheet before use.

FIG. 5 shows conductive sealing tape 40 and base portion 30 preassembled with peelable strip 45 covering adhesive on one side of conductive sealing tape 40. FIG. 14 shows multiple conductive sealing tapes 40 held on a common sheet 46 before use. The side of conductive sealing tape 40 contacting sheet 46 has an adhesive on it. Once a base portion 30 is affixed to an article to be protected, such as a box, a conductive sealing tape 40 may be removed from sheet 46 and applied to the base portion 30 and the article.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. An electronic article surveillance (EAS) apparatus comprising:

a housing enclosing EAS electronics, said housing having a bottom surface, a top surface and at least one side connecting said bottom surface and said top surface, said housing having a first attaching interface, said EAS electronics comprising a switch extending from said bottom surface of said housing and a pair of electrical contacts extending from said bottom surface of said housing, said switch having at least two states;

a base, said base having a top surface and a bottom surface, said base having a second attaching interface complimentary to said first attaching interface, said first attaching interface and said second attaching interface facilitating the releasable attachment of said housing to said base with said bottom surface of said housing facing said top surface of said base, said base comprising an aperture located to align with said switch when said housing is attached to said base; and a conductive sealing tape, said conductive sealing tape comprising a substrate having a first end, a second end, and two sides, said conductive sealing tape further comprising a conductive loop having a first end and a second end, said first end of said conductive loop being exposed proximal to said first end of said substrate, said conductive loop running the length of said substrate to proximal to said second end of said substrate and returning to proximal to said first end of said substrate, said second end of said conductive loop being exposed, said conductive sealing tape comprising adhesive on one of said sides of said substrate;

said EAS apparatus being assembled on an article to be protected by attaching said base to the article, attaching said first end of said substrate to said base and attaching at least said second end of said substrate to the article and attaching said housing to said base; wherein, when said EAS apparatus is assembled on article to be protected, a first of said electrical contacts makes contact with said first end of said conductive loop and a second of said electrical contacts makes contact with said second end of said conductive loop, an electrical circuit is completed through said conductive loop and said switch changes state.

2. The EAS apparatus of claim 1, wherein:

said EAS electronics further comprise a microprocessor, wireless communication elements, and a battery;

said microprocessor monitoring said switch for a change of state and said electrical contacts for presence of a completed circuit through said conductive loop.

3. The EAS apparatus of claim 2, wherein:

said wireless communication elements comprise radio frequency communication circuitry.

4. The EAS apparatus of claim 2, wherein:

said wireless communication elements comprise an optical port and a light emitting diode.

5. The EAS apparatus of claim 2, wherein:

said EAS electronics further comprise a sound generating element, said sound generating element generating audible cues and alarms.

6. The EAS apparatus of claim 1, wherein:

when said switch changes state and an electrical circuit is completed through said conductive loop, said EAS electronics are armed.

7. The EAS apparatus of claim 1, wherein:

when said switch changes state and an electrical circuit is completed through said conductive loop, said EAS electronics are rendered ready to be armed by an external device.

8. The EAS device of claim 1, wherein:

said EAS electronics comprise a passive EAS element.

9. The EAS apparatus of claim 1, wherein:

said second attaching interface comprises at least two fixed hooks on said base, and said first attaching interface comprises at least one hook receiving slot in said housing and a latch hook slideably mounted on a sliding latch in said housing; wherein, said at least one hook receiving slot receives a respective fixed hook and said latch hook slideably engages a respective fixed hook to maintain said housing on said base.

10. The EAS apparatus of claim 9, further comprising:

a blocking component biased to shift position to a blocking position to block the return of said sliding latch when said sliding latch is moved to engage said latch hook into said respective hook receiving slot.

11. The EAS apparatus of claim 10, wherein:

said blocking component is magnetically attractable to move it from said blocking position to allow the return of said sliding latch.

12. The EAS apparatus of claim 1, wherein:

said base is attached to an article with adhesive.

13. The EAS apparatus of claim 1, wherein:

said conductive sealing tape is preassembled to said base.

14. An electronic article surveillance (EAS) apparatus comprising:

a housing having a bottom surface, a top surface and at least one side connecting said bottom surface and said top surface, said housing having a first attaching interface;

EAS electronics enclosed in said housing, said EAS electronics comprising a microprocessor, wireless communication elements, a battery, a switch extending from said bottom surface of said housing, and a pair of electrical contacts extending from said bottom surface of said housing, said switch having at least two states;

a base, said base having a top surface and a bottom surface, said base having a second attaching interface complimentary to said first attaching interface, said first attaching interface and said second attaching interface facilitating the releasable attachment of said housing to said base with said bottom surface of said housing facing said top surface of said base, said base comprising an aperture located to align with said switch when said housing is attached to said base; and a conductive sealing tape, said conductive sealing tape comprising a substrate having a first end, a second end, and two sides and having adhesive on one of said sides, said conductive sealing tape further comprising a conductive loop having a first end and a second end, said first end and said second end of said conductive loop being exposed proximal to said first end of said substrate, said conductive loop extending along said substrate to proximal to said second end of said substrate;

said EAS apparatus being assembled on an article to be protected by attaching said base to the article, attaching said first end of said substrate to said base and attaching at least said second end of said substrate to the article and attaching said housing to said base; wherein, when said EAS apparatus is assembled on an article, a first of said electrical contacts makes contact with said first end of said conductive loop and a second of said electrical contacts makes contact with said second end of said conductive loop, completing a circuit within said EAS electronics, and said switch changes state, said microprocessor monitoring said switch for a change of state and said electrical contacts for presence of a completed circuit through said conductive loop.

15. The EAS apparatus of claim 14, wherein:

when said switch changes state and an electrical circuit is completed through said conductive loop, said EAS electronics are armed.

16. The EAS apparatus of claim 14, wherein:

when said switch changes state and an electrical circuit is completed through said conductive loop, said EAS electronics are rendered ready to be armed by an external device.

17. The EAS device of claim 14, wherein:

said EAS electronics comprise a passive EAS element.

18. The EAS apparatus of claim 14, wherein:

said second attaching interface comprises at least two fixed hooks on said base, and said first attaching interface comprises at least one hook receiving slot in said housing and a latch hook slideably mounted on a sliding latch in said housing; wherein, said at least one hook receiving slot receives a respective fixed hook and said latch hook slideably engages a respective fixed hook to maintain said housing on said base.

19. The EAS apparatus of claim 18, further comprising:

a blocking component biased to shift position to a blocking position to block the return of said sliding latch when said sliding latch is moved to engage said latch hook into said respective hook receiving slot.

20. The EAS apparatus of claim 19, wherein:

said blocking component is magnetically attractable to move it from said blocking position to allow the return of said sliding latch.

* * * * *